US011976439B2

(12) United States Patent
Wells et al.

(10) Patent No.: US 11,976,439 B2
(45) Date of Patent: May 7, 2024

(54) OVERLAPPING CUTTING EDGE TIP SYSTEM

(71) Applicant: Caterpillar Inc., Peoria, IL (US)

(72) Inventors: Corey Michael Wells, Peoria, IL (US); Douglas C. Serrurier, Morton, IL (US); Jason Grant Jura, Tremont, IL (US)

(73) Assignee: Caterpillar Inc., Peoria, IL (US)

( * ) Notice: Subject to any disclaimer, the term of this patent is extended or adjusted under 35 U.S.C. 154(b) by 385 days.

(21) Appl. No.: 17/332,076

(22) Filed: May 27, 2021

(65) Prior Publication Data

US 2022/0381003 A1 Dec. 1, 2022

(51) Int. Cl.

| | |
|---|---|
| ***E02F 3/815*** | (2006.01) |
| ***E02F 3/40*** | (2006.01) |
| ***E02F 9/28*** | (2006.01) |

(52) U.S. Cl.

CPC ..... *E02F 3/8152* (2013.01); *E02F 3/402* (2013.01); *E02F 9/28* (2013.01); *E02F 9/2858* (2013.01)

(58) Field of Classification Search

CPC ... E02F 3/40; E02F 3/402; E02F 3/405; E02F 3/8152; E02F 9/28; E02F 9/2858; E02F 9/2883

See application file for complete search history.

(56) References Cited

U.S. PATENT DOCUMENTS

| | | | | |
|---|---|---|---|---|
| 7,080,470 | B2 * | 7/2006 | Jones | E02F 9/2883 37/456 |
| 11,661,727 | B2 * | 5/2023 | Ames | E02F 9/2816 37/455 |
| 2004/0060209 | A1 * | 4/2004 | Watanabe | E02F 9/2883 37/452 |
| 2022/0372735 | A1 * | 11/2022 | Wells | E02F 3/8152 |

FOREIGN PATENT DOCUMENTS

| | | | |
|---|---|---|---|
| EP | 1403439 | | 3/2004 |
| JP | S4935102 | | 9/1974 |
| JP | 2004324132 | A * | 11/2004 |
| JP | 2006125180 | A | 5/2006 |
| JP | 2016089499 | | 5/2016 |
| JP | 2018066187 | | 4/2018 |
| JP | 3216474 | U | 5/2018 |
| JP | 6513521 | B2 | 5/2019 |
| JP | 6580017 | B2 | 9/2019 |

* cited by examiner

*Primary Examiner* — Jessica H Lutz

(57) ABSTRACT

A cutting edge tip includes an attachment portion defining an adapter receiving void. A working portion extends forwardly from the attachment portion. A first lateral end portion is disposed along the lateral direction, the first lateral end portion defining a first lateral end surface that jogs laterally. Also, a second lateral end portion is disposed along the lateral direction opposite of the first lateral end portion. The second lateral end portion also defines a second lateral end surface that jogs laterally.

20 Claims, 11 Drawing Sheets

OVERLAPPING CUTTING EDGE TIP SYSTEM

TECHNICAL FIELD

The present disclosure relates to work implement assemblies such as bucket assemblies used by earth moving, mining, construction equipment and the like. More specifically, the present disclosure relates to such assemblies that employ an overlapping cutting edge tip system.

BACKGROUND

Machines such as wheel loaders, excavators, and the like employ work implement assemblies including bucket assemblies, rakes, shears, etc. that have teeth or tips attached to them to help perform work on a material such as dirt, rock, sand, etc. For example, teeth or tips may be attached to a bucket assembly to help the bucket assembly to penetrate the ground, facilitating the scooping of the dirt into a bucket. Adapters are often attached to the work edges (e.g. the base edge, the side edge, etc.) of the bucket or other work implement so that different styles of teeth or tips may be attached to the work implement. Also, the tips or teeth may be replaced easily when worn by providing an adapter that is attached to the work implement.

More specifically, in some applications it is desirable to grade or clean the bottom surface of the dug feature such as to provide a foundation or the like. Cutting edge tips that overlap are provided for such applications. While the prior art is replete with such systems, they may not be satisfactory for all applications or may not provide suitable longevity.

Japanese Pat. No. JP6413660B2 provides a center cutting edge tip that provides for vertical overlap between two adjacent cutting edges at their joint. So, vertical support at the joint is only provided while thrust loads or side loads are not necessarily shared.

Also, Japanese Pat. No. U3216474 provides a center cutting edge tip system that provides for horizontal overlap but is not suitable to allow variable spacing between adapters.

Accordingly, a more robust overlapping cutting edge tip system that also may accommodate variable adapter spacing is warranted that provides for support in a multitude of directions at a joint between adjacent tips.

SUMMARY OF THE DISCLOSURE

A cutting edge tip according to an embodiment of the present disclosure may comprise an attachment portion defining an adapter receiving void, a direction of assembly, a lateral direction that is perpendicular to the direction of assembly, and a vertical direction that is perpendicular to the direction of assembly and the lateral direction. A working portion may extend forwardly from the attachment portion along the direction of assembly forming a front working edge. A first lateral end portion may be disposed along the lateral direction, the first lateral end portion defining a first lateral end surface that jogs laterally. Also, a second lateral end portion may be disposed along the lateral direction opposite of the first lateral end portion. The second lateral end portion may also define a second lateral end surface that jogs laterally.

A cutting edge tip according to another embodiment of the present disclosure may comprise an attachment portion defining an adapter receiving void, a direction of assembly, a lateral direction that is perpendicular to the direction of assembly, and a vertical direction that is perpendicular to the direction of assembly and the lateral direction. A working portion may extend forwardly from the attachment portion along the direction of assembly forming a front working edge. A first lateral end portion may be disposed along the lateral direction, the first lateral end portion defining a first lateral end surface, while a second lateral end portion may be disposed along the lateral direction opposite of the first lateral end portion, the second lateral end portion defining a second lateral end surface. The front working edge may include a first working edge portion that extends laterally inwardly from the first lateral end surface at a first vertical level, a second working edge portion that extends from the first working edge portion and that is positioned at a second vertical level that is higher than the first vertical level of the first working edge portion, and a third working edge portion that extends from the second working edge portion to the second lateral end surface that is positioned at a third vertical level that is higher than the second vertical level of the second working edge portion.

A side cutting edge tip according to an embodiment of the present disclosure may comprise an attachment portion defining an adapter receiving void, a direction of assembly, a lateral direction that is perpendicular to the direction of assembly, and a vertical direction that is perpendicular to the direction of assembly and the lateral direction. A working portion may extend forwardly from the attachment portion along the direction of assembly forming a front working edge. A first lateral end portion may be disposed along the lateral direction, the first lateral end portion defining a first lateral end surface that jogs laterally, and a second lateral end portion may be disposed along the lateral direction opposite of the first lateral end portion, the second lateral end portion defining a second lateral end surface that jogs laterally. The first lateral end portion may include a sidewall that extends vertically upwardly from the working portion.

BRIEF DESCRIPTION OF THE DRAWINGS

FIG. 2 illustrates the bucket assembly being moved in a grading motion as the bucket is pulled toward a work machine such as an excavator or the like.

DETAILED DESCRIPTION

Figure 1:
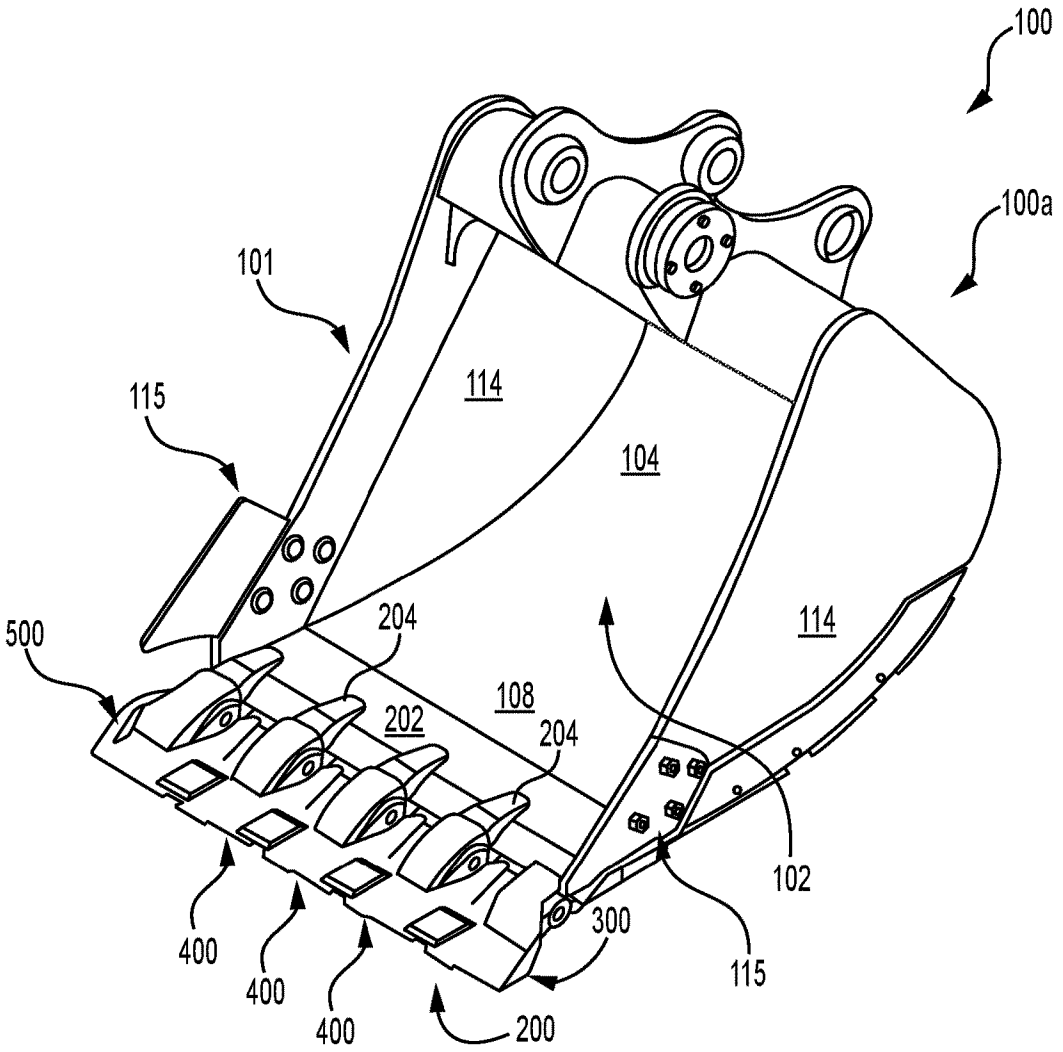
FIG. 1 is a perspective view of a work implement assembly such as a bucket assembly using an overlapping cutting edge tip system (OCETS) on the bottom front lip of the bucket assembly according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function such as is often the case when geometry is mirrored about a plane of symmetry. For ease of explanation in this specification, letters or primes will often not be included herein but may be shown in the drawings to indicate duplications of features discussed within this written specification.

An overlapping cutting edge tip system (OCETS) that may include a right cutting edge tip, a center cutting edge tip(s), and a left cutting edge tip according to various embodiments of the present disclosure will now be discussed.

Figure 2:
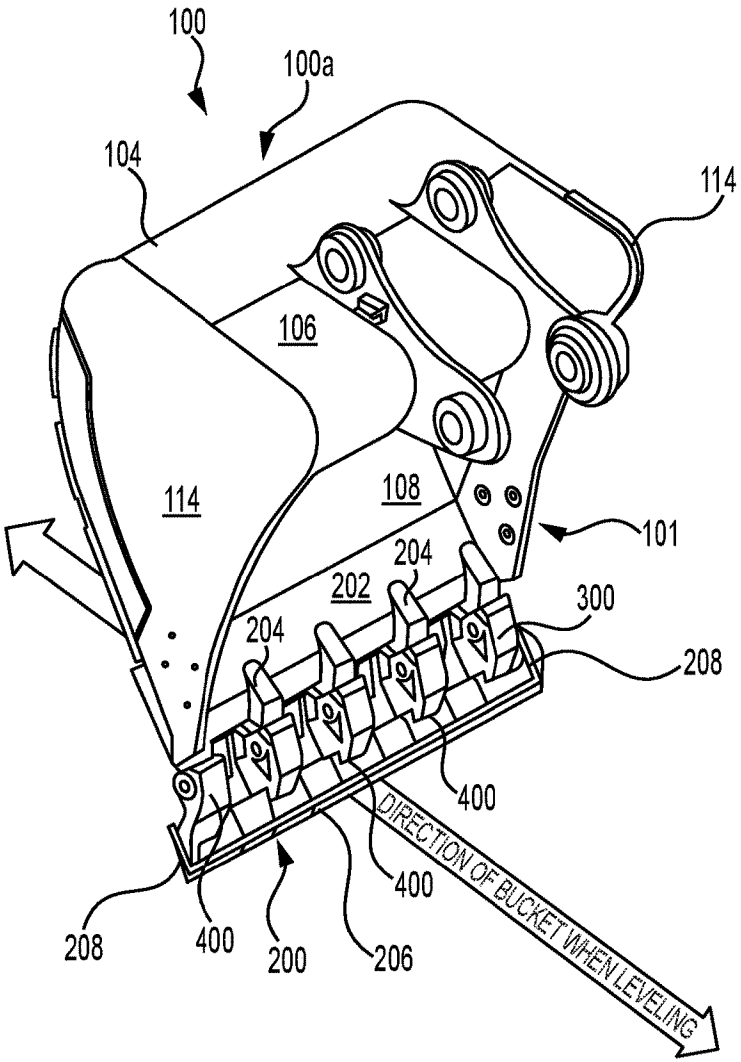

Starting with FIGS. 1 and 2, the work implement assembly 100 may take the form of a bucket assembly 100*a* that includes an enclosure 101 that defines an opening 102 that communicates with a generally enclosed interior. Starting from the rear of the bucket assembly 100*a*, the bucket assembly 100*a* includes a curved shell profile 104, which is attached to a top wall 106 at the top end of the shell 104. The other end of the shell is attached to the bottom plate 108 of the assembly 100. Two substantially flat end plates 114 are attached to the side edges of the top plate 106, bottom plate 108 and shell 104.

A side edge assembly 115 is attached to each end plate 114 while a front edge assembly 200 (herein after referred to as the OCETS) is attached to the front edge of the bottom plate 108 of the bucket assembly 100. The front edge assembly 200 includes a base edge 202 (may also be referred to as a front lip), a plurality of center adapters 204 attached to the base edge 202, and a plurality of cutting edge tips 300, 400, 500 with each one being attached to one of the plurality of center adapters 204. Also, two corner adapters may be provided in some embodiments also that may also be attached to the base edge 202 and/or the side edges.

It is to be understood the work implement assembly may take other forms other than a bucket assembly including rake assemblies, shear assemblies, etc. Also, any of the embodiments of the cutting edge tips may be used in any of these other forms of work implement assemblies including other differently configured bucket assemblies.

Figure 8:
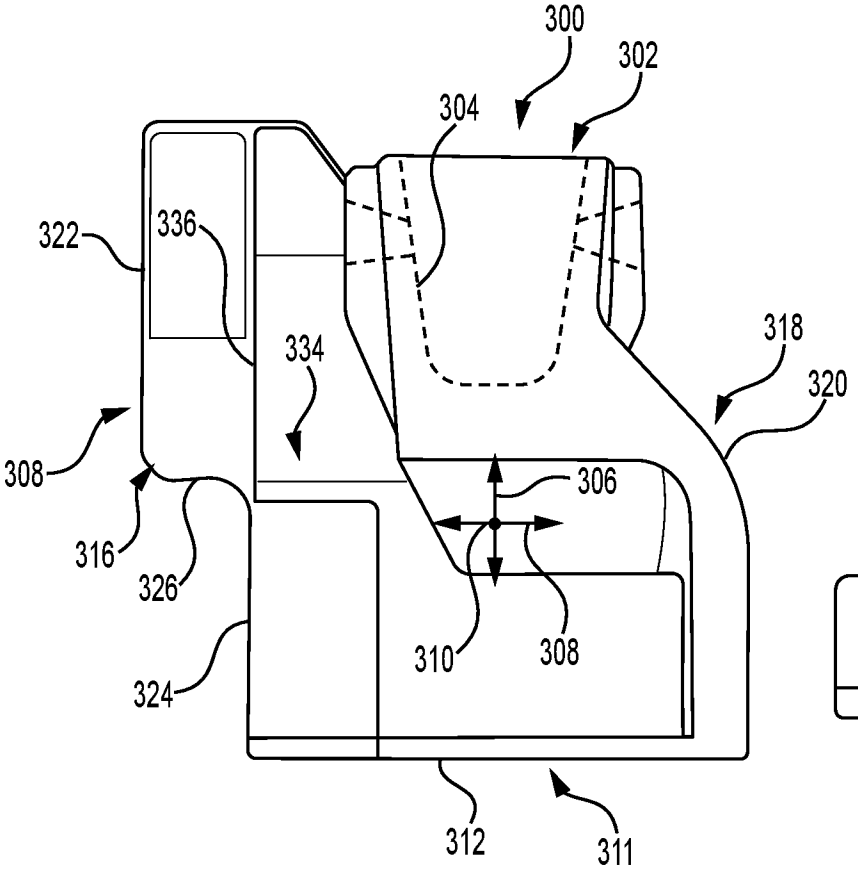
FIG. 8 is a top view of the right cutting edge tip of FIGS. 6 and 7.
Figure 10:
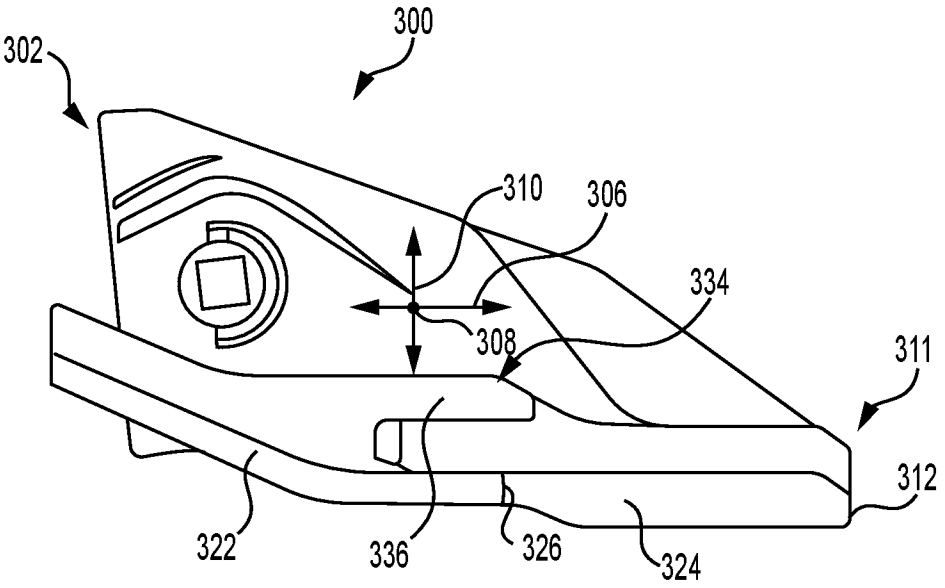
FIG. 10 is a left side view of the right cutting edge tip of FIG. 8.
Figure 11:
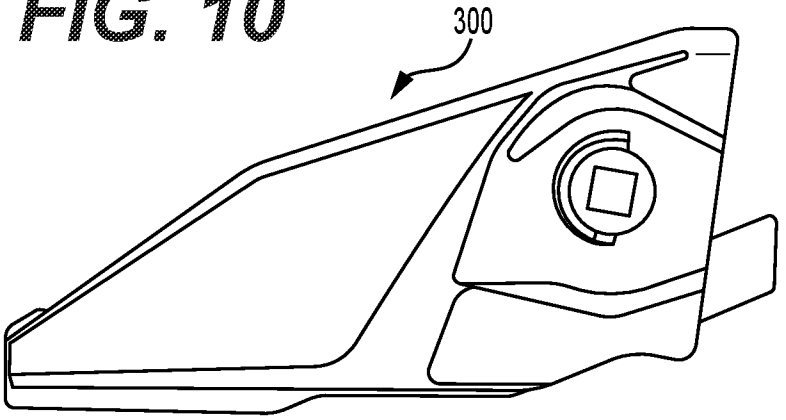
FIG. 11 is a right side view of the right cutting edge tip of FIG. 8.

Referring now to FIGS. 6 thru 19, an embodiment of a cutting edge tip 300, 400, 500 will now be discussed in more detail. Focusing on FIGS. 8, 12, and 16, such a cutting edge tip 300, 400, 500 may comprise an attachment portion 302, 402, 502 defining an adapter receiving void 304, 404, 504, a direction of assembly 306, 406, 506, a lateral direction 308, 408, 508 that is perpendicular to the direction of assembly, and a vertical direction 310, 410, 510 that is perpendicular to the direction of assembly and the lateral direction.

A working portion 311, 411, 511 may extend forwardly from the attachment portion 302, 402, 502 along the direction of assembly direction of assembly 306, 406, 506 forming a front working edge 312, 412, 512. Also, a first lateral end portion 314, 414, 514 may be disposed along the lateral direction 308, 408, 508. The first lateral end portion 314, 414, 514 may define a first lateral end surface 316, 416, 516 that jogs laterally. Similarly, a second lateral end portion 318, 418, 518 may be disposed along the lateral direction 308, 408, 508 opposite of the first lateral end portion 314, 414, 514. The second lateral end portion 318, 418, 518 may also define a second lateral end surface 320, 420, 520 that jogs laterally.

As best seen in FIGS. 8, 10, 12 and 14, the first lateral end surface 316, 416 may include a first lateral outside end face 322, 422 (defines a lateral extremity) that extends along the direction of assembly 306, 406 and the vertical direction 310, 410 (e.g., at least a portion of this surface extends at an angle to the horizontal plane), and that is disposed laterally adjacent the attachment portion 302, 402. In addition, a first lateral inside end face 324, 424 (spaced laterally inwardly from 322, 422) may extend along the direction of assembly 306, 406 (i.e., this is the direction of greatest extent for this surface), and that is disposed laterally adjacent the working portion 311, 411. A first transitional surface 326, 426 may be interposed between the first lateral outside end face 322, 422, and the first lateral inside end face 324, 424. The first transitional surface 326, 426 may extend laterally between these surfaces 322, 422, 324, 424 (i.e., lateral direction is the direction of greatest extent for this surface). More particularly, the first transitional surface 326, 426 may be perpendicular to the direction of assembly 306, 406, as well as the first lateral outside end face 322, 422, and the first lateral inside end face 324, 424 in some embodiments of the present disclosure.

Focusing now on FIGS. 12, 15, 16 and 19, it may be understood that the second lateral end surface 420, 520 may include a second lateral outside end face 428, 528 that extends along the direction of assembly 406, 506 (dimension of greatest extent) and that is disposed laterally adjacent the working portion 411, 511. Moreover, a second lateral inside end face 430, 530 may extend along the direction of assembly 406, 506, and the vertical direction 410, 510 (e.g. at least a portion of this surface may be angled relative to the horizontal plane), and that is disposed laterally adjacent the attachment portion 402, 502. Also, a second transitional surface 432, 532 may be interposed between the second lateral outside end face 428, 528, and the second lateral inside end face 430, 530. This second transitional surface

432, 532 may extend predominately laterally in some embodiments of the present disclosure.

Figure 12:
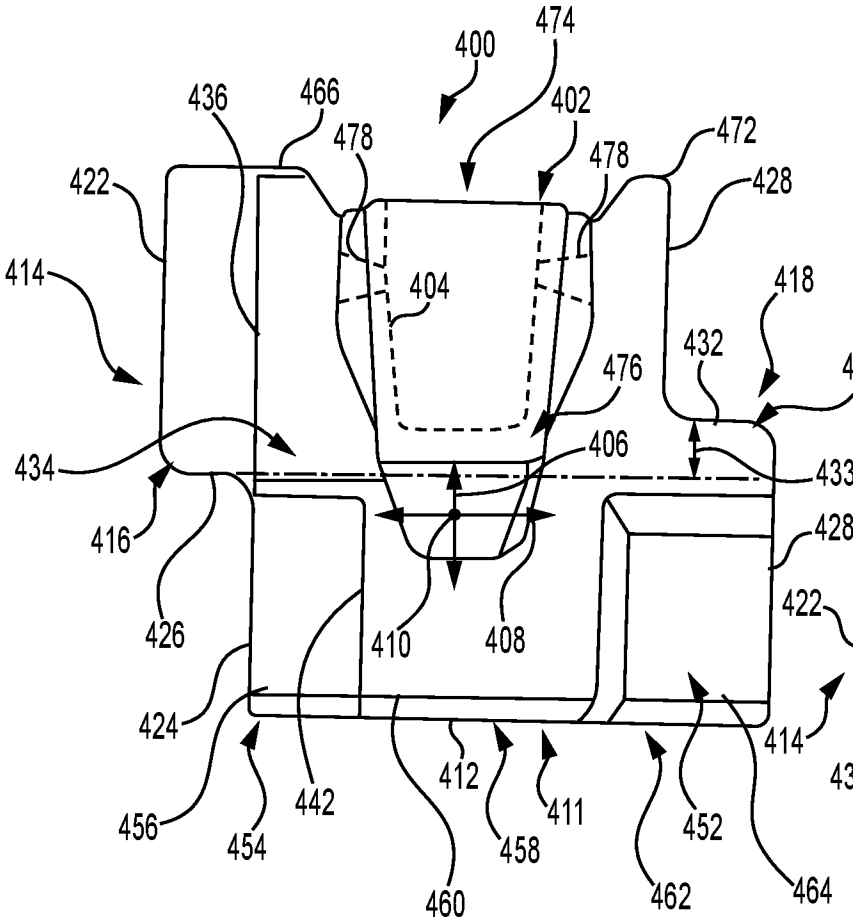
FIG. 12 is a top view of the center cutting edge tip of FIGS. 6 and 7.
Figure 15:
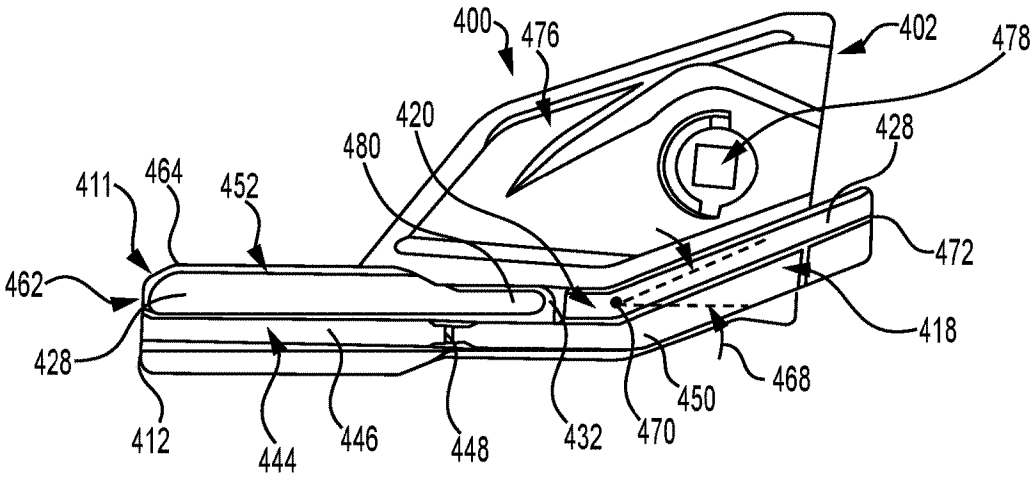
FIG. 15 is a right side view of the center cutting edge tip of FIG. 12.
Figure 17:
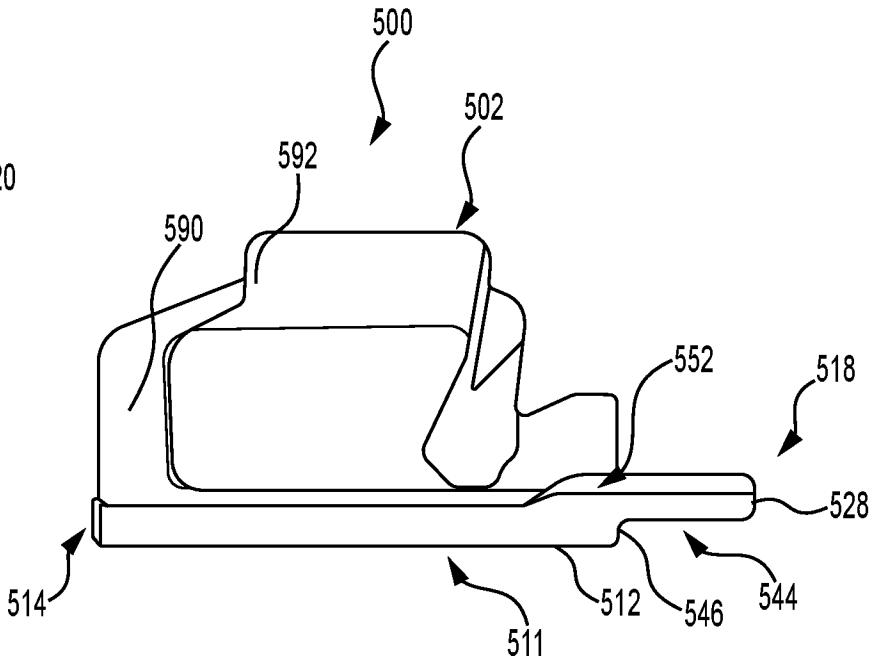
FIG. 17 is a front view of the left cutting edge tip of FIG. 16.

As best seen in FIGS. 12 and 15, the second transitional surface 432 may be perpendicular to the direction of assembly 406, the second lateral outside end face 428, and the second lateral inside end face 430. In FIG. 12, the second transitional surface 432 is spaced a predetermined distance 433 (e.g., greater than 5.0 mm in some embodiments) from the first transitional surface 426 rearwardly along the direction of assembly 406, and the first lateral end surface 416 is at least partially complementarily shaped as the second lateral end surface 420. The configuration of these features may allow the first lateral end portion to mate or interlock with the second lateral end portion. Other configurations of these features are possible in other embodiment of the present disclosure.

To that end, in FIGS. 8 thru 10, and 12 thru 14, an overhanging ledge 334, 434 may extend laterally from a ledge side face 336, 436 that is disposed vertically above the first lateral inside end face 324, 424 toward the attachment portion 302, 402.

Figure 13:
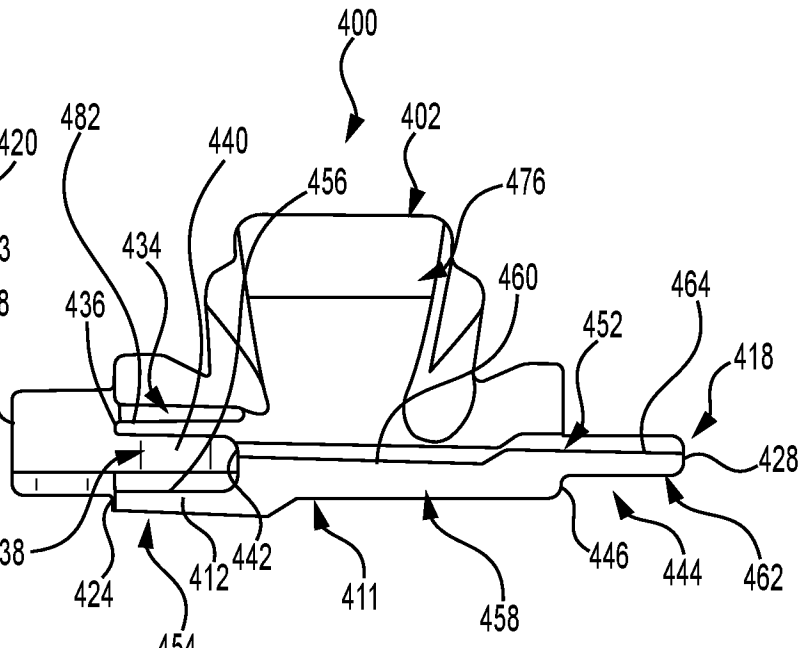
FIG. 13 is a front view of the center cutting edge tip of FIG. 12.
Figure 14:
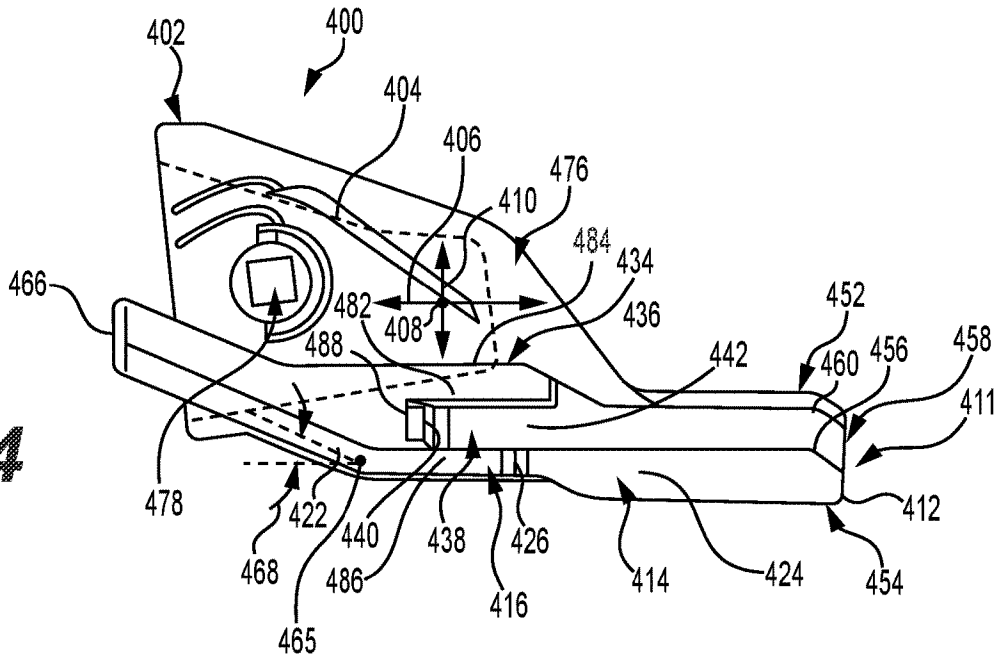
FIG. 14 is a left side view of the center cutting edge tip of FIG. 12.

In FIGS. 13 and 14, the overhanging ledge 434 may define a first lateral end slot 438 that is delimited by a rear surface 440 that is coplanar with or rearwardly offset from the second lateral transitional surface 432, and by a third lateral inside end face 442 that is offset laterally inwardly from the first lateral inside end face 424. Similar structure may be seen in FIGS. 9 and 10.

Referring now to FIGS. 13, 15, 17 and 19, it may be understood that the second lateral end portion 418, 518 may define a bottom pocket 444, 544 that is delimited by a third lateral outside end face 446, 546 that is offset laterally inwardly from the second lateral outside end face 428, 528. A third transitional surface 448, 548 may extend laterally inwardly from the third lateral outside end face 446, 546. The third transitional surface 448, 548 may be coplanar with or forwardly offset from the first transitional surface 426 (only shown for embodiment 400). A fourth transitional surface 450, 550 may extend rearwardly along the direction of assembly and vertically upwardly from the third transitional surface 448, 548.

A boss 452, 552 may be disposed above the bottom pocket 444, 544 that extends laterally outwardly from the working portion 411, 511 to the second lateral outside end face 428, 528, and rearwardly from the front working edge 412, 512 along the direction of assembly 406, 506. This boss 452, 552 may terminate approximately above the third transitional surface 448, 548. This features may be differently configured in other embodiments of the present disclosure.

Now, a particular embodiment of a center cutting edge tip will be discussed with reference to FIGS. 12 thru 15.

Such a cutting edge tip 400 may comprise an attachment portion 402 defining an adapter receiving void 404, a direction of assembly 406, a lateral direction 408 that is perpendicular to the direction of assembly 406, and a vertical direction 410 that is perpendicular to the direction of assembly 406 and the lateral direction 408. A working portion 411 may extend forwardly from the attachment portion 402 along the direction of assembly 406 forming a front working edge 412 as previously described herein.

Similarly, a first lateral end portion 414 may be disposed along the lateral direction 408 that defines a first lateral end surface 416. This surface may or may not jog in various embodiments of the present disclosure.

Likewise, a second lateral end portion 418 may be disposed along the lateral direction 408 opposite of the first lateral end portion 414. Also, the second lateral end portion 418 may define a second lateral end surface 420 that may or may not jog in various embodiments of the present disclosure.

The front working edge 412 may include a first working edge portion 454 that extends laterally inwardly from the first lateral end surface 416 at a first vertical level 456, a second working edge portion 458 that extends laterally from the first working edge portion 454 and that is positioned at a second vertical level 460 that is higher than the first vertical level 456 of the first working edge portion 454, and a third working edge portion 462 that extends laterally from the second working edge portion 458 to second lateral end surface 420. This third working edge portion 462 may be positioned at a third vertical level 464 that is higher than the second vertical level 460 of the second working edge portion 458.

Looking at FIG. 14, the first lateral end surface 416 may extend from the first working edge portion 454 along the direction of assembly 406 until it teaches a transitional axis 465. Then, the first lateral end surface 416 may extend from the transitional axis 465 to a first rear extremity 466 of the cutting edge tip at an oblique ramp angle 468 with the direction of assembly 406. This may not be the case in other embodiments of the present disclosure. Also, other dimensions and angles are possible.

Similarly in FIG. 15, the second lateral end surface 420 extends from the third working edge portion 462 along the direction of assembly 406 to a different transitional axis 470. From there, the second lateral end surface 420 extends to a second rear extremity 472 of the cutting edge tip at the same oblique ramp angle 468.

As seen in FIG. 12, the cutting edge tip 400 may define a partially trapezoidal slot 474 that is delimited by the first rear extremity 466, the second rear extremity 472, and the attachment portion 402. This may not be the case in other embodiments of the present disclosure.

Likewise, in FIGS. 14 and 15, the attachment portion 402 may include a prismatic cone shape 476 defining the adapter receiving void 404. A lock receiving aperture 478 may be in communication with the adapter receiving void 404. When looking at FIGS. 14, 15, and 3 together, the first lateral end portion 414 may include a socket (e.g., see 438), and the second lateral end portion 418 may include a tongue 480 that is configured to fit within the socket.

The socket may include a top fork portion 482 that is disposed at a fourth vertical level 484 that is higher than the third vertical level 464 of the third working edge portion 462, a bottom fork portion 486 that extends rearwardly from the first working edge portion 454 along the direction of assembly 406, and a connecting portion 488 that connects the top fork portion 482 and the bottom fork portion 486. The tongue 480 may be disposed laterally away from the socket at the second vertical level 456 of the second working edge portion 458. Again, other configurations are possible in other embodiments of the present disclosure.

Next, a side cutting edge tip such as shown in FIGS. 16 thru 19 will be discussed.

For example, such a cutting edge tip 500 may comprise an attachment portion 502 defining an adapter receiving void 504, a direction of assembly 506, a lateral direction 508 that is perpendicular to the direction of assembly, and a vertical direction 510 that is perpendicular to the direction of assembly 506 and the lateral direction 508. A working portion 511 may extend forwardly from the attachment portion 502 along the direction of assembly 506, forming a front working edge 512.

A first lateral end portion 514 is disposed along the lateral direction that defines a first lateral end surface 516 that jogs laterally. A second lateral end portion 518 is disposed along the lateral direction opposite of the first lateral end portion 514, the second lateral end portion 518, defining a second lateral end surface 516 that jogs laterally. The first lateral end portion 514 may include a sidewall 590 that extends vertically upwardly from the working portion 511. A similar description may be made with respect to FIGS. 8 thru 11, except that the features would be mirrored.

As seen in FIGS. 16 thru 19, the sidewall 590 extends vertically upwardly, and rearwardly along the direction of assembly 506 from the front working edge 512 to a top surface 592 of the attachment portion 502, while also forming the first lateral end surface 516. Again, a similar description may be made with respect to FIGS. 8 thru 11, except that the features would be mirrored.

Figure 16:
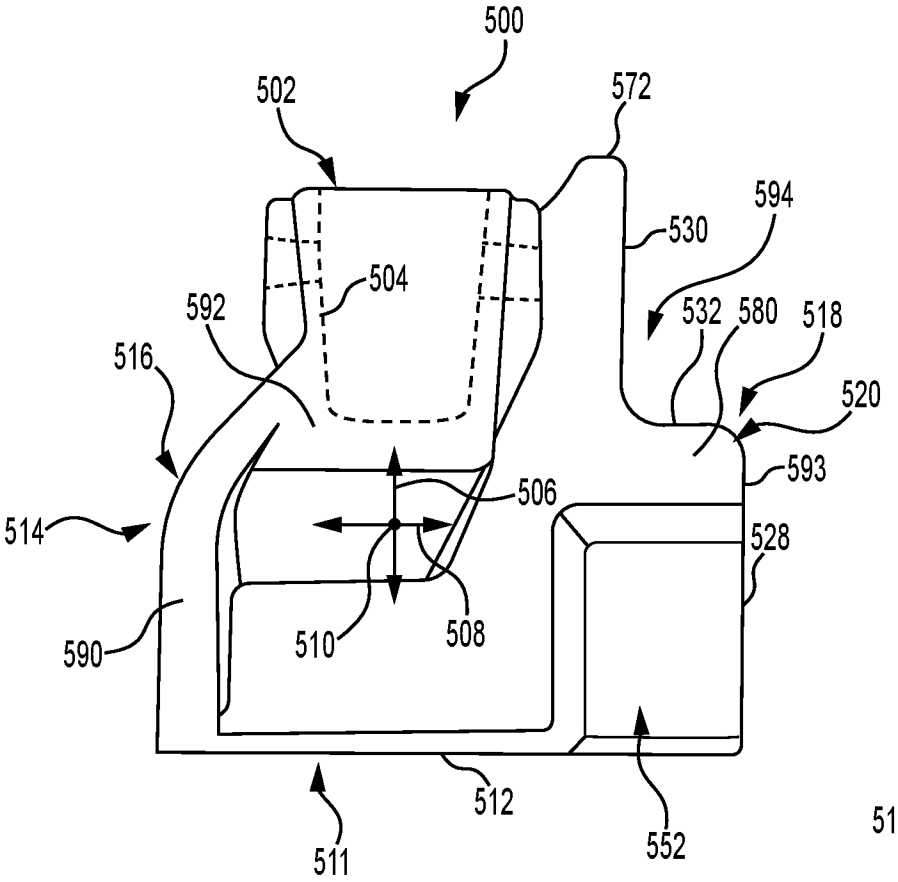
FIG. 16 is a top view of the left cutting edge tip of FIGS. 6 and 7.
Figure 18:
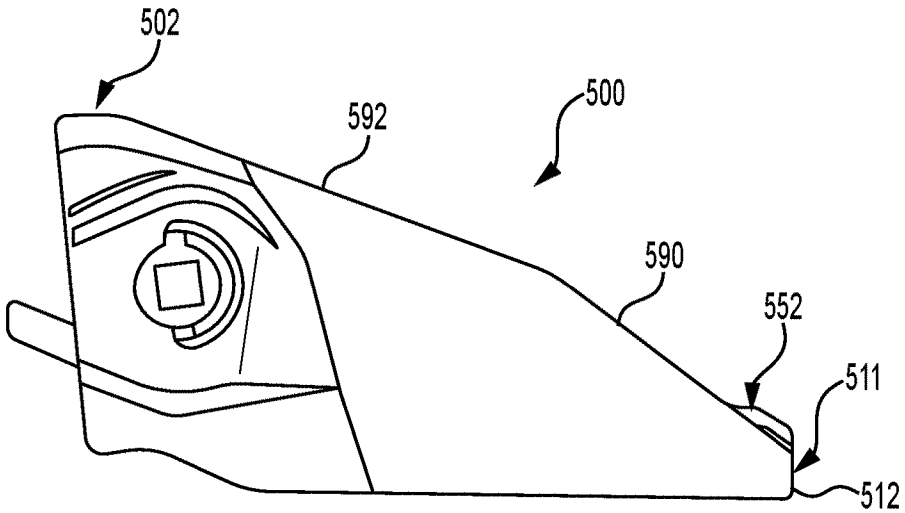
FIG. 18 is a left side view of the left cutting edge tip of FIG. 16.
Figure 19:
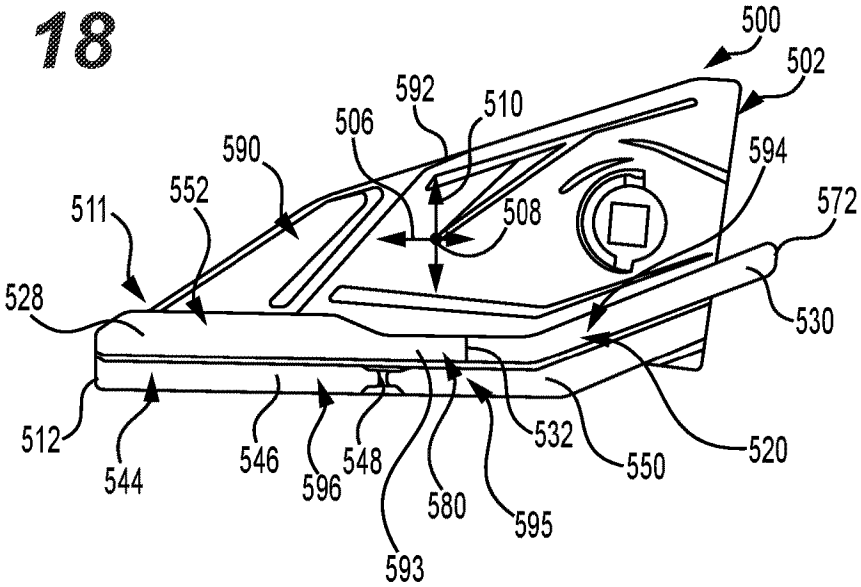
FIG. 19 is a right side view of the left cutting edge tip of FIG. 16.

In FIGS. 16 and 19, the second lateral end surface 520 at least partially defines a tongue portion 580 defining a lateral extremity 593 of the side cutting edge 500, and further defines a slot 594 that is disposed rearwardly of the tongue portion 580 along the direction of assembly 506, extending to a rear extremity 572 of the side cutting edge 500.

A socket portion 595 may be disposed laterally between the second lateral end surface 520 and the attachment portion 502, and a recess 596 may be disposed laterally outwardly adjacent to the socket portion 595, extending forwardly to the front working edge 512 along the direction of assembly 506. A pad (e.g., see boss 552) may be disposed laterally adjacent the lateral extremity 593, and adjacent to the front working edge 512 along the direction of assembly 506.

Again, it should be noted that any of the dimensions, angles, surface areas and/or configurations of various features may be varied as desired or needed including those not specifically mentioned herein. Although not specifically discussed, blends such as fillets are shown to connect the various surfaces. These may be omitted in other embodiments and it is to be understood that their presence may be ignored sometimes when reading the present specification unless specifically mentioned.

INDUSTRIAL APPLICABILITY

In practice, a machine, a work implement assembly, an OCETS, or any component thereof may be manufactured, bought, or sold to retrofit a machine or a work implement assembly in the field in an aftermarket context, or alternatively, may be manufactured, bought, sold or otherwise obtained in an OEM (original equipment manufacturer) context.

Any of the aforementioned components may be made from any suitable material including iron, grey-cast iron, steel, etc.

Various features of the OCETS may have the following performances. First, as seen in FIG. 2, as evidenced by line 206, the working edge formed by the OCETS is designed to wear back evenly over time. Also, lines 208 indicated that the extra material at the corners may help to maintain square corners throughout the wear life of the side cutting edge tips.

Figure 3:
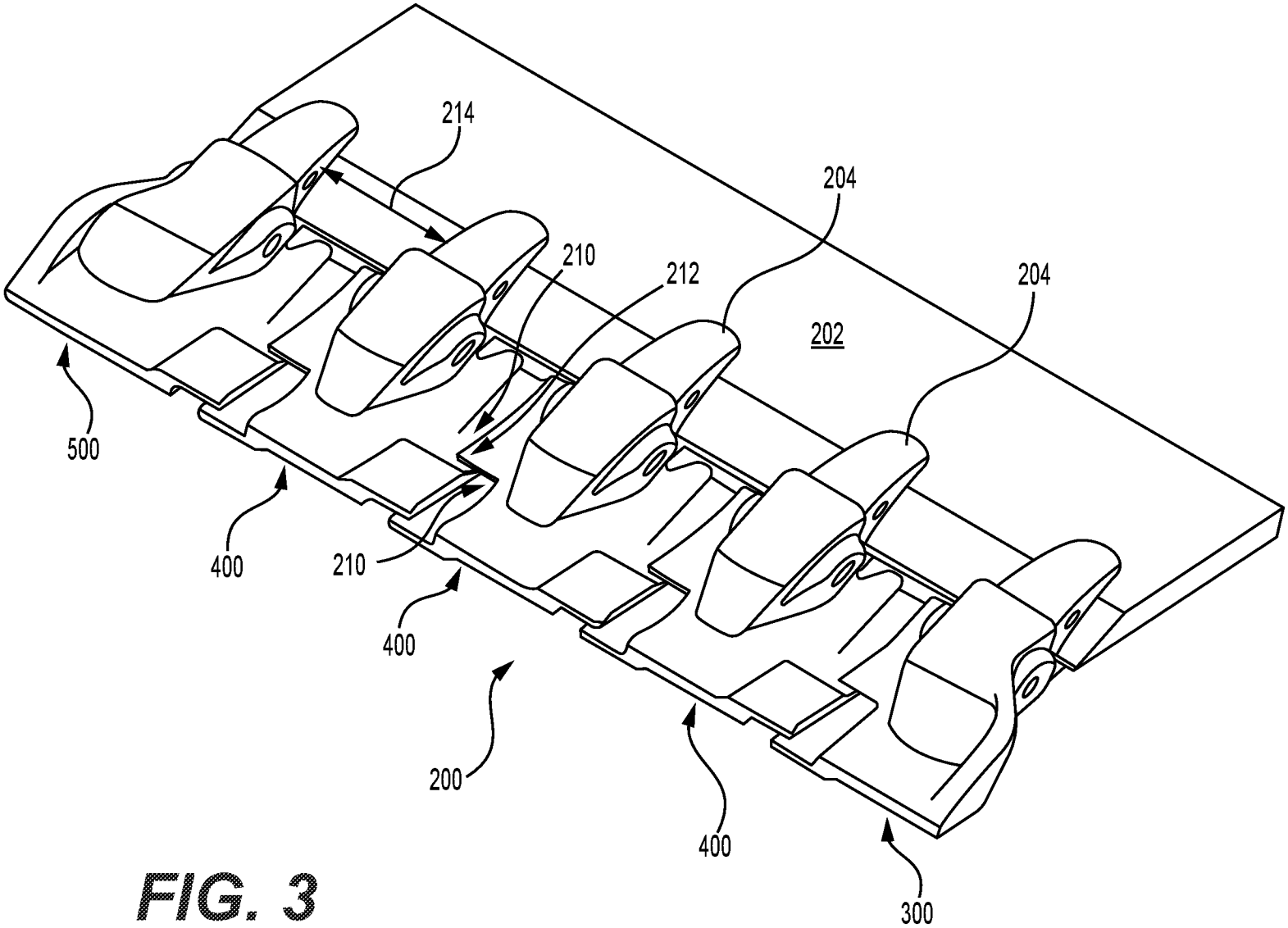
FIG. 3 is a perspective view of the OCETS attached to the bottom front lip of the bucket assembly of FIGS. 1 and 2, shown in isolation from the rest of the bucket assembly.
Figure 4:
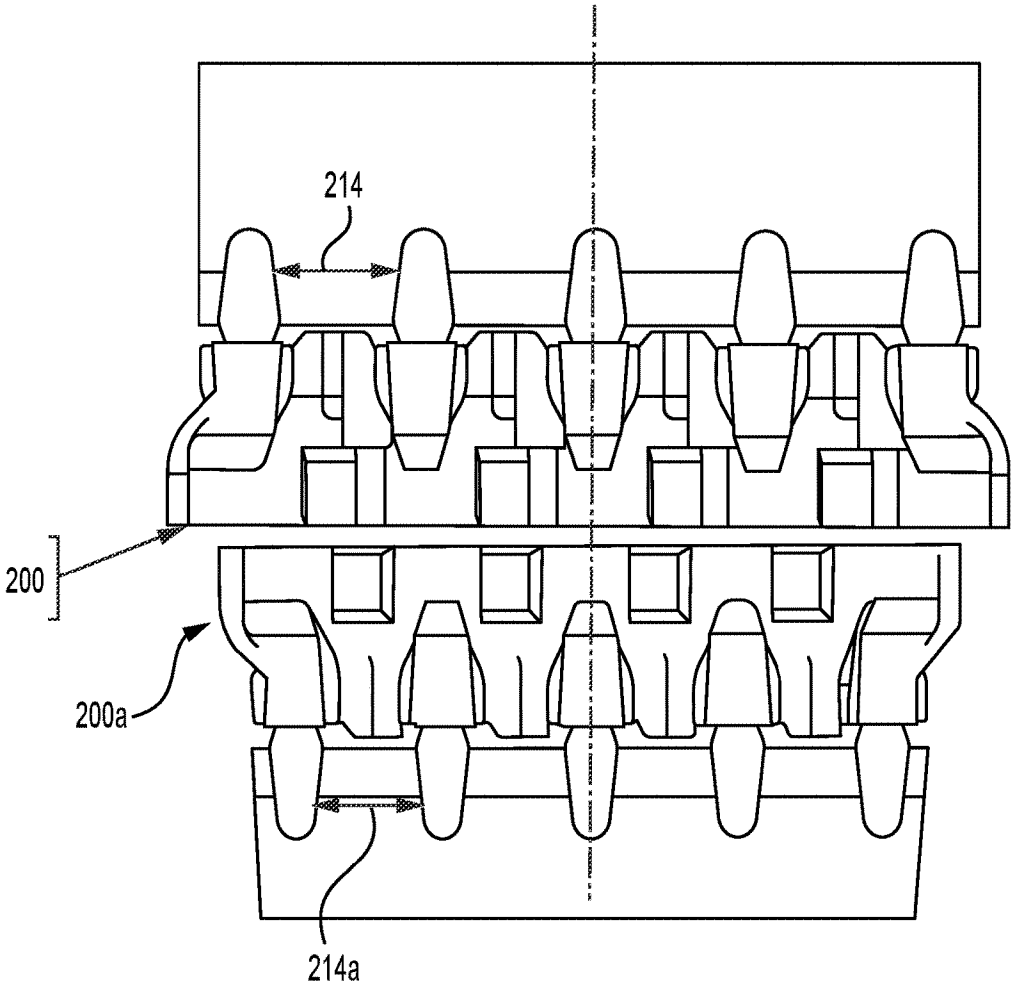
FIG. 4 is a top view of the overlapping cutting edge tip system being employed on two differently configured front lips. The top embodiment illustrates how the system may be used with a wider spacing of adapters, while the bottom embodiment illustrates how the same system may be used with a narrower spacing of adapters.

In FIG. 3, arrows 210 indicate that the stepped/staggered overlap 212 of the edges prevents material from flowing/channeling the entire distance of the tip to reduce wear when loading and dumping the bucket or other wear implement, etc. At the same time, variable adapter spacing 214 is possible. This concept is reinforced in FIG. 4 where the spacing 214 taken from FIG. 3 (see top instance 200) is reduced to 214*a* (see bottom instance 200*a*). This is a critical result not taught by the prior art.

Figure 5:
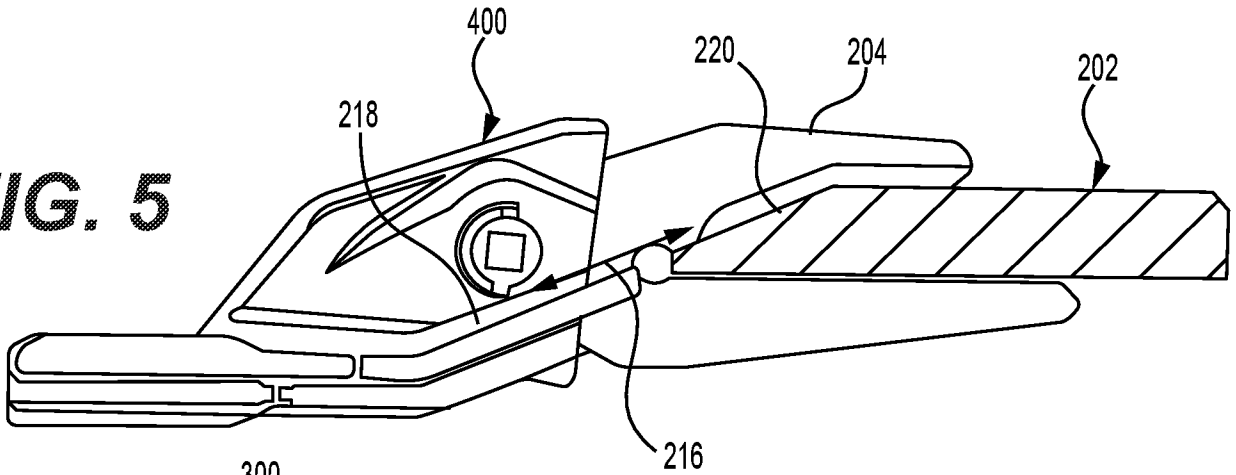
FIG. 5 is a right side view of a center cutting edge tip of the OCETS of FIG. 3 showing how the tip matches the slant of the front lip to ease the ingress and egress of material into and out of the bucket.
Figure 6:
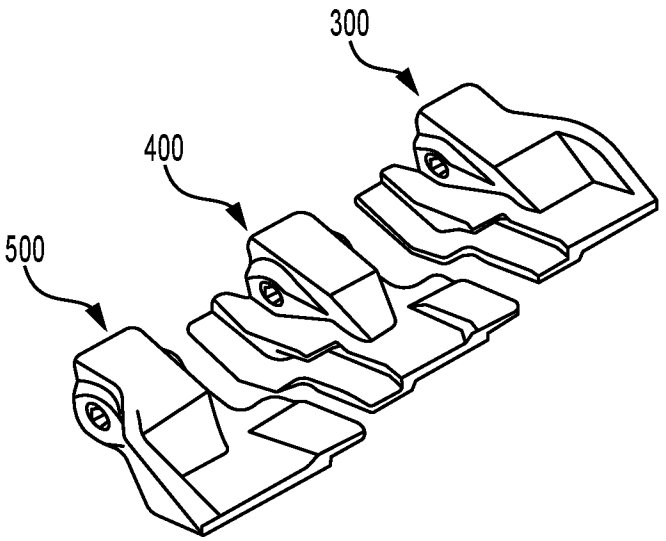
FIG. 6 is a left oriented perspective view of a left cutting edge tip, a center cutting edge tip, and a right cutting edge tip employed in the OCETS.
Figure 7:
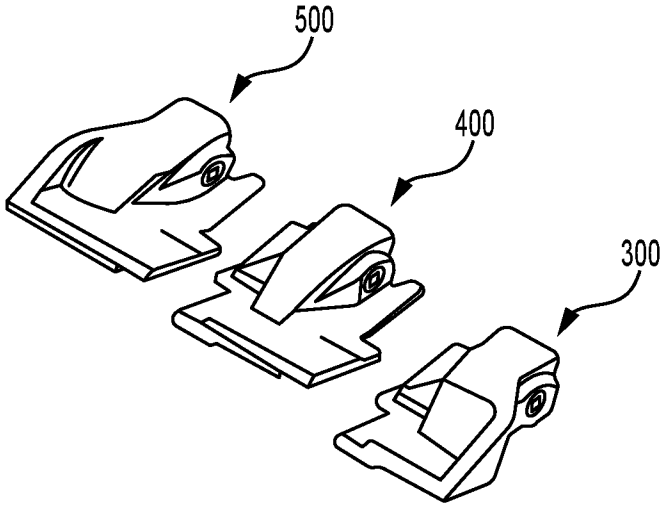
FIG. 7 is a right oriented perspective view of the cutting edge tips of FIG. 6.
Figure 9:
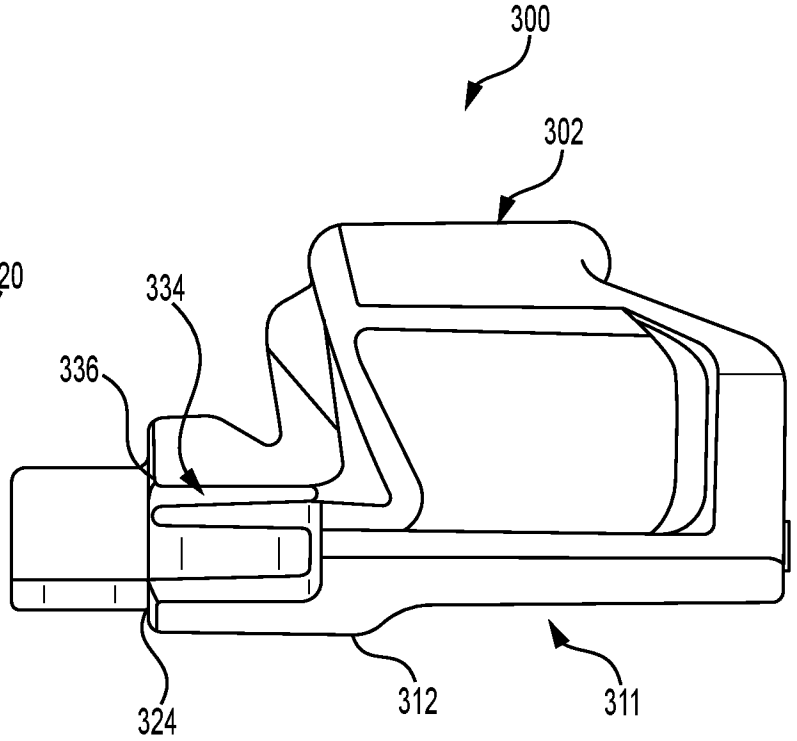
FIG. 9 is a front view of the right cutting edge tip of FIG. 8.

FIG. 5 illustrates the smooth ingress and egress of material represented by arrow 216. This is true since the ramp surface 218 of the OCETS is vertically below the beveled surface 220 of the base edge 202, while also being parallel.

The socket and tongue connection such as shown in FIG. 3 (see 212), also allows support in both upward and downward vertical directions, making the OCETS more robust.

In order to maintain consistency and versatility during the assembly process, the first lateral end portion of the right cutting edge tip may be similarly or identically configured as the first lateral end portion of the center cutting edge tip. Similarly, the second lateral end portion of the left cutting edge tip may be similarly or identically configured as the second lateral end portion of the center cutting edge tip, etc.

During assembly, the right cutting edge tip would typically be first to be attached to the rightmost adapter, then the center cutting edge tips would typically be attached to the adapters sequentially from right to left, and the left cutting edge tip would typically be last to be attached to the leftmost adapter.

The sidewalls on the left and right cutting edge tips may be similarly or identically configured. They may be ramped and provide a funneling path for incoming material into the bucket or other work implement, etc.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A cutting edge tip comprising:

an attachment portion defining an adapter receiving void, a direction of assembly, a lateral direction that is perpendicular to the direction of assembly, and a vertical direction that is perpendicular to the direction of assembly and the lateral direction;

a working portion that extends forwardly from the attachment portion along the direction of assembly forming a front working edge;

a first lateral end portion that is disposed along the lateral direction, the first lateral end portion defining a first lateral end surface that jogs laterally, and the first lateral end surface including:

a first lateral outside end face, a first lateral inside end face, and a first transitional surface that is interposed between the first lateral outside end face and the first lateral inside end face; and a second lateral end portion that is disposed along the lateral direction opposite of the first lateral end portion, the second lateral end portion defining a second lateral end surface that jogs laterally, the second lateral end surface including:

a second lateral outside end face, a second lateral inside end face, and a second transitional surface that is interposed between the second lateral outside end face and the second lateral inside end face, and the second lateral end portion further defining a bottom pocket that is delimited by a third lateral outside end face, a third transitional surface that extends laterally inwardly from the third lateral outside end face, and a fourth transitional surface that extends rearwardly along the direction of assembly.

2. The cutting edge tip of claim 1, wherein the first lateral outside end face extends along the direction of assembly and the vertical direction, wherein the first lateral outside end face is disposed laterally adjacent the attachment portion, wherein the first lateral inside end face extends along the direction of assembly and is disposed laterally adjacent the working portion, and wherein the first transitional surface extends laterally.

3. The cutting edge tip of claim 1, wherein the first transitional surface is perpendicular to the direction of assembly, the first lateral outside end face, and the first lateral inside end face.

4. The cutting edge tip of claim 1, wherein the second lateral outside end face extends along the direction of assembly, wherein the second lateral outside end face is disposed laterally adjacent the working portion, wherein the second lateral inside end face extends along the direction of assembly, and the vertical direction and is disposed laterally adjacent the attachment portion, and wherein the second transitional surface extends laterally.

5. The cutting edge tip of claim 1, wherein the second transitional surface is perpendicular to the direction of assembly, the second lateral outside end face, and the second lateral inside end face, wherein the second transitional surface is spaced a particular distance from the first transitional surface rearwardly along the direction of assembly, and wherein the first lateral end surface is at least partially complementarily shaped as the second lateral end surface.

6. The cutting edge tip of claim 1, further comprising:

an overhanging ledge that extends laterally from a ledge side face that is disposed vertically above the first lateral inside end face toward the attachment portion, the overhanging ledge defining a first lateral end slot that is delimited by:

a rear surface that is coplanar with or rearwardly offset from the second transitional surface, and a third lateral inside end face that is offset laterally inwardly from the first lateral inside end face.

7. The cutting edge tip of claim 5, further comprising:

a boss that is disposed above the bottom pocket, wherein the boss extends:

laterally outwardly from the working portion to the second lateral outside end face, and rearwardly from the front working edge along the direction of assembly.

8. The cutting edge tip of claim 1, wherein the third lateral outside end face that is offset laterally inwardly from the second lateral outside end face.

9. The cutting edge tip of claim 1, wherein the third transitional surface is coplanar with or forwardly offset from the first transitional surface.

10. The cutting edge tip of claim 1, wherein the fourth transitional surface is vertically upwardly from the third transitional surface.

11. A cutting edge tip comprising:

an attachment portion defining an adapter receiving void, a direction of assembly, a lateral direction that is perpendicular to the direction of assembly, and a vertical direction that is perpendicular to the direction of assembly and the lateral direction;

a working portion that extends forwardly from the attachment portion along the direction of assembly forming a front working edge;

a first lateral end portion disposed along the lateral direction, the first lateral end portion defining a first lateral end surface, and the first lateral end surface including a first transitional surface; and a second lateral end portion disposed along the lateral direction opposite of the first lateral end portion, the second lateral end portion defining a second lateral end surface, the second lateral end surface including a second transitional surface, and the second lateral end portion further defining a bottom pocket that is delimited by at least a third transitional surface that extends laterally inwardly from a lateral outside end face and a fourth transitional surface that extends rearwardly along the direction of assembly.

12. The cutting edge tip of claim 11, wherein the front working edge includes:

a first working edge portion that extends laterally inwardly from the first lateral end surface at a first vertical level, and a second working edge portion that extends from the first working edge portion and that is positioned at a second vertical level that is higher than the first vertical level, and wherein the first lateral end surface extends from the first working edge portion along the direction of assembly to a transitional axis, and extends from the transitional axis to a first rear extremity of the cutting edge tip at an oblique ramp angle with the direction of assembly.

13. The cutting edge tip of claim 12, wherein the front working edge further includes a third working edge portion that extends from the second working edge portion to the second lateral end surface that is positioned at a third vertical level that is higher than the second vertical level, and wherein the second lateral end surface extends from the third working edge portion along the direction of assembly to a different transitional axis, and extends from the different transitional axis to a second rear extremity of the cutting edge tip at the same oblique ramp angle.

14. The cutting edge tip of claim 11, wherein the first lateral end portion includes a socket, and wherein the second lateral end portion includes a tongue that is configured to fit within the socket.

15. The cutting edge tip of claim 8, wherein the first lateral end portion includes a socket, wherein the front working edge includes:

a first working edge portion that extends laterally inwardly from the first lateral end surface at a first vertical level, a second working edge portion that extends from the first working edge portion and that is positioned at a second vertical level that is higher than the first vertical level, and a third working edge portion that extends from the second working edge portion to the second lateral end surface that is positioned at a third vertical level that is higher than the second vertical level, and wherein the socket includes:

a top fork portion that is disposed at a fourth vertical level that is higher than the third vertical level, a bottom fork portion that extends rearwardly from the first working edge portion along the direction of assembly, and a connecting portion that connects the top fork portion and the bottom fork portion together.

16. A side cutting edge tip comprising:

an attachment portion defining an adapter receiving void, a direction of assembly, a lateral direction that is perpendicular to the direction of assembly, and a vertical direction that is perpendicular to the direction of assembly and the lateral direction;

a working portion that extends forwardly from the attachment portion along the direction of assembly forming a front working edge;

a first lateral end portion disposed along the lateral direction, the first lateral end portion defining a first lateral end surface that jogs laterally, and the first lateral end surface including a first transitional surface; and a second lateral end portion that is disposed along the lateral direction opposite of the first lateral end portion, the second lateral end portion defining a second lateral end surface that jogs laterally, the second lateral end surface including a second transitional surface, the second lateral end portion further defining a bottom pocket that is delimited by at least a third transitional surface that extends laterally inwardly from a lateral outside end face and a fourth transitional surface that extends rearwardly along the direction of assembly, and the first lateral end portion including a sidewall that extends vertically upwardly from the working portion.

17. The side cutting edge tip of claim 16, wherein the sidewall extends vertically upwardly, and rearwardly along the direction of assembly from the front working edge to a top surface of the attachment portion, also forming the first lateral end surface.

18. The side cutting edge tip of claim 16, wherein the second lateral end surface at least partially defines a tongue portion defining a lateral extremity of the side cutting edge tip, and further defines a slot that is disposed rearwardly of the tongue portion along the direction of assembly, extending to a rear extremity of the side cutting edge tip.

19. The side cutting edge tip of claim 16, further comprising:

a socket portion disposed laterally between the second lateral end surface and the attachment portion, and a recess that is disposed laterally outwardly adjacent to the socket portion, extending forwardly to the front working edge along the direction of assembly.

20. The side cutting edge tip of claim 18, further comprising a pad that is disposed laterally adjacent the lateral extremity and adjacent to the front working edge.

* * * * *